US008929768B2

(12) United States Patent
Zona et al.

(10) Patent No.: US 8,929,768 B2
(45) Date of Patent: Jan. 6, 2015

(54) METHOD OF REMANUFACTURING A TONER CARTRIDGE AND REMANUFACTURED TONER CARTRIDGE

(71) Applicant: Xerox Corporation, Norwalk, CT (US)

(72) Inventors: Michael F. Zona, Holley, NY (US); Karen L. Lamora, Marion, NY (US)

(73) Assignee: Xerox Corporation, Norwalk, CT (US)

( * ) Notice: Subject to any disclaimer, the term of this patent is extended or adjusted under 35 U.S.C. 154(b) by 76 days.

(21) Appl. No.: 13/896,664

(22) Filed: May 17, 2013

(65) Prior Publication Data

US 2014/0341609 A1 Nov. 20, 2014

(51) Int. Cl.
*G03G 21/18* (2006.01)
*G03G 15/08* (2006.01)

(52) U.S. Cl.
CPC ..... *G03G 15/0894* (2013.01); *G03G 21/181* (2013.01)
USPC ..... 399/109

(58) Field of Classification Search
CPC ..... G03G 15/0894; G03G 21/181; G03G 2215/00987
USPC ..... 399/90, 109
See application file for complete search history.

(56) References Cited

U.S. PATENT DOCUMENTS

| | | | | |
|---|---|---|---|---|
| 5,150,807 | A | 9/1992 | Seyfried et al. | |
| 5,594,198 | A | 1/1997 | Ikeda et al. | |
| 5,648,838 | A * | 7/1997 | Michlin et al. | 399/119 |
| 5,826,140 | A | 10/1998 | Zona et al. | |
| 6,397,025 | B1 | 5/2002 | Higeta et al. | |
| 6,941,092 | B2 | 9/2005 | Yokoi | |
| 7,024,131 | B2 | 4/2006 | Komatsu et al. | |
| 7,031,646 | B2 * | 4/2006 | Yasukawa et al. | 399/281 |
| 7,062,199 | B1 | 6/2006 | Higeta et al. | |
| 7,286,790 | B2 | 10/2007 | Preston et al. | |
| 8,095,027 | B2 | 1/2012 | Mori et al. | |
| 8,150,301 | B2 | 4/2012 | Adachi et al. | |
| 2009/0087217 | A1 | 4/2009 | Norris et al. | |
| 2013/0039675 | A1 | 2/2013 | Holmes et al. | |

* cited by examiner

*Primary Examiner* — David Gray
*Assistant Examiner* — Gregory H Curran
(74) *Attorney, Agent, or Firm* — Fay Sharpe LLP

(57) ABSTRACT

Provided herein is a method of remanufacturing a toner cartridge for use in a xerographic process, as well as a toner cartridge remanufactured by the disclosed method. According to one exemplary embodiment, the remanufacturing method includes electrically connecting a resistor of a predetermined resistance between a toner supply roll contact and a development roll contact, the resistor modifying the electric field between the toner supply roll and development roll, where the remanufactured toner cartridge includes toner of triboelectric charge properties different from the original toner.

21 Claims, 6 Drawing Sheets

METHOD OF REMANUFACTURING A TONER CARTRIDGE AND REMANUFACTURED TONER CARTRIDGE

BACKGROUND

The present disclosure relates to a method for remanufacturing toner cartridges.

In the well-known process of electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In a printer, as the toner within the developer material is transferred to the photoreceptor and eventually to the copy paper, this used toner must be replaced. The printer thus includes a container or cartridge from which fresh toner is dispensed into the machine. To provide for a small, compact cartridge and to provide for a cartridge in which the cartridge may be easily removed, the cartridge typically has a compact shape.

Service costs represent a significant portion of the cost associated with operating a printing machine. Certain components represent those most likely to require service. By providing a method of easily replacing those certain components, the operator may replace those components himself, avoiding service technician labor costs.

These certain components are consolidated within a housing that may be easily replaced by the customer. This housing is typically called a customer replaceable unit (CRU). Typically included in a CRU are toner, a cleaning blade, the charging device (a corotron or a bias charge roll), and the photoreceptor.

A CRU is changed several times during the life of a copy machine. While a few of the components within a CRU are consumed during the life of the CRU many of the components may be reused. Therefore, the CRU is now being frequently remanufactured rather than being replaced. The remanufacturing includes refilling the CRU with new toner and inspecting all components that wear. Worn components are replaced.

INCORPORATION BY REFERENCE

U.S. Pat. No. 5,150,807, by Seyfried et al., issued Sep. 29, 1992 and entitled "APPARATUS FOR STORING MARKING PARTICLES";

U.S. Pat. No. 5,594,198, by Ikeda et al., issued Jan. 14, 1997 and entitled "DEVELOPING DEVICE USING ONE-COMPONENT TYPE DEVELOPER";

U.S. Pat. No. 5,826,140, by Zona et al., issued Oct. 20, 1994 and entitled "METHOD OF REMANUFACTURING TONER CARTRIDGES";

U.S. Pat. No. 7,286,790, by Preston et al., issued Oct. 23, 2007 and entitled "TRICKLE COLLECTION SYSTEM AND METHOD, AND ELECTROPHOTOGRAPHIC SYSTEM USING THE SAME";

U.S. Pat. No. 8,095,027, by Mori et al., issued Jan. 10, 2012 and entitled "IMAGE FORMING DEVICE AND PROCESS CARTRIDGE";

U.S. Pat. No. 8,150,301, by Adachi et al., issued Apr. 3, 2012 and entitled "DEVELOPING APPARATUS"; are incorporated herein by reference in their entirety.

BRIEF DESCRIPTION

In one embodiment of this disclosure, described is a method of remanufacturing a non-magnetic toner cartridge associated with a first toner, the cartridge including a toner storage area, a toner supply roll, a development roll and a photosensitive drum, the method comprising a) refilling the toner storage area with a second toner, a triboelectric charge property associated with the second toner different from a triboelectric charge property associated with the first toner; and b) electrically connecting a resistor of a predetermined resistance between a toner supply roll contact and a development roll contact, the predetermined resistance of the resistor associated with a relative difference of the triboelectric charge properties associated with the first toner and second toner, wherein the resistor modifies an electric field between the toner supply roll and development roll during a use of the toner cartridge during an electrostatic process.

In another embodiment of this disclosure, described is a remanufactured non-magnetic toner cartridge comprising a toner storage area including replacement toner associated with a triboelectric charge property different than an original toner associated with the cartridge; a toner supply roll operatively connected to a first electrical contact configured to connect to a power source external to the cartridge; a development roll operatively connected to a second electrical contact configured to connect to a power source external to the cartridge; a photosensitive drum; and a resistor operatively connected to the first electrical contact and the second electrical contact, wherein the resistor modifies an electric field between the toner supply roll and development roll to lead the replacement toner onto the development roll during a use of the toner cartridge during an electrostatic process.

In still another embodiment of this disclosure, described is a method of modifying an electrical field between a toner supply roll and a development roll associated with a remanufactured non-magnetic toner cartridge including a replacement toner, the method comprising operatively connecting a resistor between the toner supply roll and the development roll, wherein a resistance value of the resistor is selected to modify the electric field between the toner supply roll and the development roll based on a triboelectric property associated with the replacement toner.

DETAILED DESCRIPTION

Figure 1:
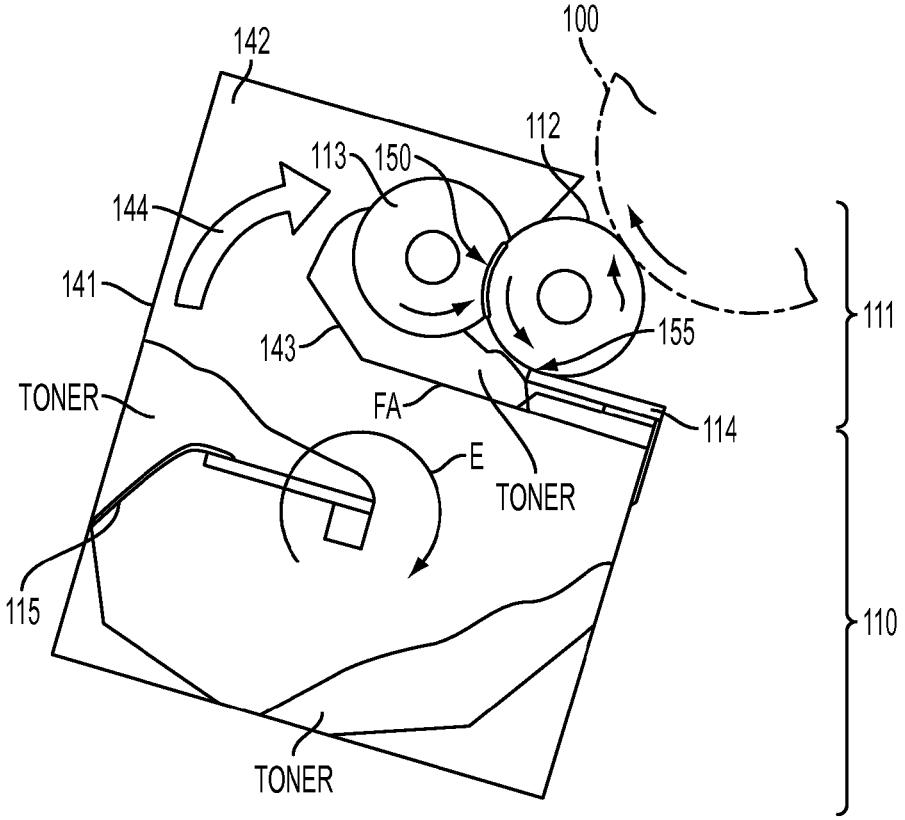
FIG. 1 is a cross-section view of a non-magnetic toner cartridge.

This disclosure provides a method to modify the electric field between a development roll and toner supply roll for a single component development system to improve the development characteristics of the toner cartridge, i.e. single component development system, using aftermarket toner. By placing a resistor between the electrical contacts of the development roll and the toner supply roll, the electric field can be reduced to adjust the loading of the aftermarket toner onto the development roll. This manner of remanufacturing the toner cartridge overcomes the limitation of not being able to adjust any of the xerographic set points in a machine and provides a control to effect the development efficiency of the aftermarket solution including a replacement toner which has triboelectric charging properties different from an original toner associated with the toner cartridge. Some benefits include a method of modifying the electric field between a supply roll and development roll in order to reduce the selective development of a toner that has a Wrong Sign (WS)/Low Charge (LC) tail in the distribution. This will extend the life of the cartridge before accumulation of WS/LC toner reduces development and darkness of the prints. Also, third party remanufacturers of toner cartridges have no control over the xerographic set points or development hardware design, aside from charge blade height, associated with the printer which will use the remanufactured toner cartridge. The simple addition of a resistor into the remanufactured assembly is a relatively low cost method of making third party cartridges work with a plurality of toners, avoiding costs associated with further optimization of a toner.

According to one exemplary embodiment, a resistor is connected across the Development and Supply rolls, which have a very high resistance nip between them. Normal operating current is very low due to the high resistance associated with the nip, so the added current through the new resistor causes the power supply voltage to drop. This gives a more consistent voltage drop, based on the power supply characteristic I-V curve, than adding a resistor, such as a potentiometer, in series to the Supply Roll since the current is so low and likely varies with Relative Humidity (RH) and machine tolerances.

Toner designs are available and being developed for remanufacturing all-in-one cartridges with a third party aftermarket component supplier. Some of these cartridges are non-magnetic, single component architectures, where a specific toner is designed to work with aftermarket components, i.e. photoreceptor, cleaning blade, etc. Getting equivalent flow properties and charging performance of the original equipment manufacturer (OEM) toner, i.e. suspension polymerization, can be challenging. Importantly, the xerographic set points and hardware parameters of a machine are optimized for the OEM toner, and not field adjustable to work with a replacement toner provided by a third party.

Provided herein is a method to modify the electric field between the development roll and toner supply roll in order to improve the development characteristics of the cartridges using aftermarket toner. By placing a resistor in between the contacts of the two rolls, the electric field is reduced to adjust the loading of the replacement toner onto the development roll, overcoming a limitation of not being able to adjust any of the xerographic set points in the machine.

In a third party aftermarket arrangement, a third party supplier sources components, such as photoreceptors, cleaning blades, seals, etc., and develops a remanufacturing process including instructions, fixtures and hand tools, along with a toner, to provide a remanufacturing solution for a toner cartridge to be used in a printer, copier and/or multi-function device (MFD). Typically, the third party supplier reuses many of the OEM components when they remanufacture one of the toner cartridges. In particular, the development hardware, i.e. development roll, toner supply roll and the charge/metering blade, get cleaned and reused. The photoreceptor drum, cleaning blade, toner, and cartridge memory chip usually get replaced with new aftermarket components. In this situation, the toner charging and flow properties must optimized to work using the OEM designed development hardware that gets reused in the process. In addition, as previously discussed, the machine settings are not adjustable to work with a remanufactured cartridge solution in the field. The xerographic set points, such as exposure level, background charge level, development potential, etc., that were optimized for the OEM cartridge hardware and materials, are design constraints that must be accommodated by the aftermarket solution to enable OEM-like print performance. Given the development hardware and fixed machine setting constraints, the only "knobs" available to adjust the development performance are toner design and/or the adjustment of the charge/metering blade location in the cartridge during the remanufacturing assembly process.

Referring to FIG. 1, the general structure of a developing apparatus will be described. Notably, FIG. 1, as well as the description of FIG. 1 which follows, is substantially consistent with the description of a developing apparatus as described in U.S. Pat. No. 8,150,301. The developing method employed by the developing apparatus is of a contact type which uses a nonmagnetic single-component developer.

The developing apparatus in this embodiment has a housing 141, including a toner storage chamber 110 and a development chamber 111.

The toner storage chamber 110 stores toner. It has a toner conveying member 115, which is a flexible blade. The toner conveying member 115 is rotated in the direction indicated, conveying thereby the toner in the toner storage chamber 110 to the development chamber 111 while stirring the toner.

There are a development roller 112, a toner supply roller 113, and a regulating blade 114, in the development chamber 111. The development roller 112 is a developer bearing member, and is rotated in the direction indicated. The toner supply roller 113 is a member which coats the development roller 112 with developer. It is rotated in the direction indicated. The regulating blade 114 is a member which regulates the amount by which developer is allowed to remain coated on the peripheral surface of the photosensitive drum 100, per unit area, after the developer is coated on the peripheral surface of the photosensitive drum 100.

The development chamber 111 in this embodiment is located on top of the toner storage chamber 110. There is an opening 142 between the development chamber 111 and toner storage chamber 110, allowing the toner in the housing 141 to move between the toner storage chamber 110 and development chamber 111. As the toner conveying member 115 is rotated, the toner in the toner storage chamber 110 is conveyed, as if being flipped up, into the development chamber 111 through the opening 142, as indicated by arrow mark 144.

The development chamber 111 is provided with a toner storage 143, which stores the toner conveyed from the toner storage chamber 110. The developing apparatus is structured so that the toner supply roller 113 is partially or fully enclosed in the toner storage 143. The toner supply roller 113 is placed in contact with the development roller 112. It is rotated in such a direction that in the area of contact between the toner supply roller 113 and development roller 112, i.e. nip 150, the peripheral surface of the toner supply roller 113 moves in the direction opposite to that in which the peripheral surface of the development roller 112 moves. That is, in the area of nip 150, the peripheral surface of the development roller 112 moves downward, whereas, the peripheral surface of the toner supply roller 113 moves upward. In other words, in terms of the rotational direction of the toner supply roller 113, the downstream edge of nip area 150 is roughly straight above the upstream edge.

The toner in the toner storage 143 is conveyed to the nip area 150 between the toner supply roller 113 and development roller 112 by the rotation of the toner supply roller 113, to be coated on the development roller 112. When the toner is coated on the peripheral surface of the development roller 112 by the toner supply roller 113, the toner is charged by the friction between the toner and development roller 112. The toner supply roller 113 also scrapes away the toner remaining on the peripheral surface of the development roller 112 after the development of a latent image.

It is in the development chamber 111 that the blade 114 is disposed as a regulating member, being kept pressed against the peripheral surface of the development roller 112. After the toner is coated on the peripheral surface of the development roller 112, the layer of toner on the development roller 112 is regulated in thickness, while being given electrical charge, by the blade 114. As a result, a thin layer of toner is formed on the peripheral surface of the development roller 112.

The development roller 112 is positioned so that its peripheral surface is kept pressed against the peripheral surface of the photosensitive drum 100, forming thereby a developing area, in which the contact pressure between the development roller 112 and photosensitive drum 100 has a preset value. The development roller 112 is rotated so that in the developing area, its peripheral surface moves in the same direction as the moving direction of the peripheral surface of the photosensitive drum 100, with the presence of a preset amount of difference between its peripheral velocity and that of the photosensitive drum 100.

The thin toner layer formed on the peripheral surface of the development roller 112 by the blade 114 is conveyed by the rotation of the development roller 112 to the development area between the development roller 112 and photosensitive drum 100, in which the latent image on the peripheral surface of the photosensitive drum 100 is developed. The toner particles remaining on the peripheral surface of the development roller 112, that is, the toner particles which were not used for the development of the latent image are removed from the peripheral surface of the development roller 112 by the toner supply roller 113.

As the development roller 112 and toner supply roller 113 rotate in the abovementioned directions, respectively, pressure is generated on the upstream side of the area of the development area, in terms of the rotational direction of the toner supply roller 113. Thus, this force pushes the toner in the toner storage 143, into the opening 142, along with air, and falls back into the toner storage chamber 110. Thus, the toner n the toner storage 143 does not stagnate in the toner storage 143. That is, the body of toner in the toner storage 143 is continuously replaced by the next body of toner, which is conveyed into the toner storage 143 from the toner storage chamber 110; toner is circulated through the toner storage 143.

The development roller 112 employed by the developing apparatus in the embodiment of FIG. 1 is a semiconductive elastic roller. It is provided with an elastic layer, and, according to one exemplary embodiment, is 16 mm in external diameter. The material for the semiconductive elastic layer is a soft rubber or a foamed substance, such as silicone rubber, urethane, etc., in which electrically conductive substance, such as carbon, has been dispersed, and the volume resistivity of which is in a range of $10^2$ ohm·cm-$10^{10}$ ohm·cm according to one exemplary embodiment. In some cases, it is formed of a combination of the abovementioned substances.

The toner supply roller 113 is an elastic roller, which is 16 mm in external diameter according to one exemplary embodiment. Its elastic surface layer is formed of an electrically conductive foamed substance, i.e. a conductive sponge. It is kept pressed against the development roller 112 so that the amount of its apparent intrusion into the development roller 112, in the area of nip 150, is 1.5 mm, according to one exemplary embodiment.

The blade 114 is a piece of plate spring. It is kept in contact with the peripheral surface of the development roller 112, being elastically bent in curvature, so that a preset amount of contact pressure is maintained between the blade 114 and development roller 112, in the area of contact 155.

In this embodiment, −350 V and −550 V are applied to the development roller 112 and toner supply roller 113, respectively. To the blade 114, −550 volts is applied.

The developer used by the developing apparatus in this embodiment is a nonmagnetic single-component toner, which is negatively chargeable.

The process speed of the image forming apparatus in this embodiment, that is, the peripheral velocity of the photosensitive drum 100, is 150 mm/sec, whereas the peripheral velocity of the development roller 112 is 180 mm/sec.

At this point in time, what characterizes this embodiment, more specifically, the method for supplying the development roller 112 with only the normally charged toner particles, and the structural arrangement for carrying out this method, will be described.

First, the voltage to be applied to the toner supply roller 113 will be described.

In this embodiment, the voltage or toner supply bias applied to the toner supply roller 113 is greater in absolute value than the voltage applied to the development roller 112. The voltage applied to the development roller 112 is the same in polarity as the polarity to which toner is charged. More specifically, to the development roller 112, −350 V is applied, and to the toner supply roller 113, −550 V is applied.

That is, to the toner supply roller 113, such voltage that is the same in polarity as the developer toner, and provides a difference in voltage of −200 V between the toner supply roller 113 and development roller 112, is applied. In other words, the voltage applied to the toner supply roller 113 is set so that its polarity is the same as the normal polarity to which the developer is chargeable, being therefore the same as the voltage applied to the development roller 112, and also, that its absolute value is greater than that of the voltage applied to the development roller 112.

In general, as described above, FIG. 1 shows a cross-section of the development hardware for a non-magnetic single component cartridge, as disclosed in U.S. Pat. No. 8,150,301. The toner sump area 110 contains toner that gets loaded onto the supply roll 113, which then transfers to the development roll 112. A paddle 115 transports the toner to develop roll loading zone area 111. The supply roll rotates in the opposite direction compared to the development and typically at a slower speed. The development roll rotates against the charge/metering blade 114 that applies a force against the development roll. At the nip 155 of the blade, the toner is charged by friction against the roll surface, and is metered to a uniform thickness. This charged layer of toner is brought in contact with the latent image on the photoreceptor in a development nip area. After development, the supply roll also functions to strip any remaining toner off the development roll in nip area 150 to get it back into the toner sump.

Figure 2:
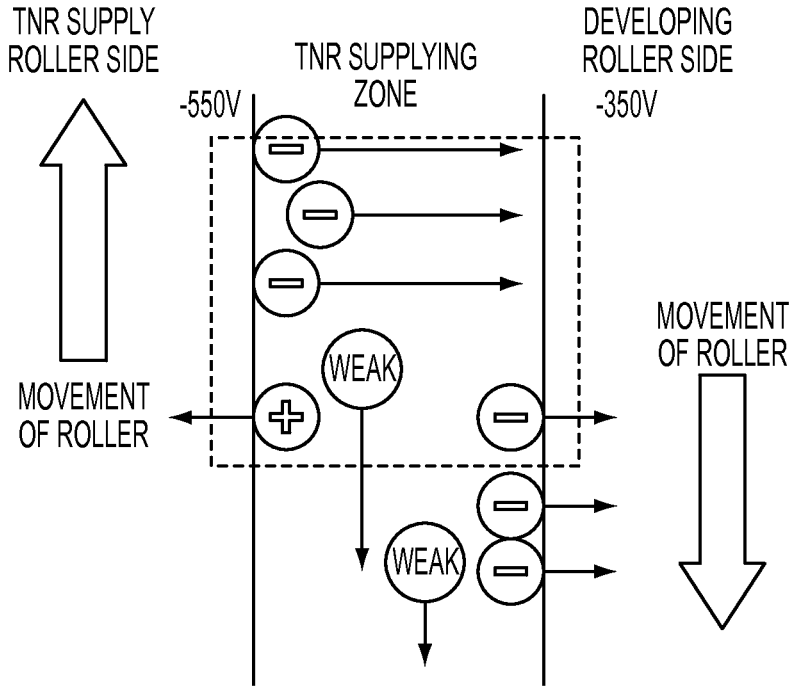
FIG. 2 is a schematical illustration of the movement of toner from a toner supply roll to a development roll.

Nip area 150 in FIG. 1 is a critical area to the development process. In this area, toner is applied to the development roll at the beginning of the contact area, and also stripped from the development at the exit of the contact area. In faster machines, there is typically an electrical field supplied between the development components. The development roll is biased in order to provide sufficient latent image development to the photoreceptor. According to one example, this is around −350 DC Volts. The supply roll is biased at a higher negative voltage, e.g. −550 DC volts, in order to ensure that well charged toner particles are attracted to the development in the loading step. FIG. 2, which is also substantially provided in U.S. Pat. No. 8,150,301, shows the electrical characteristics of the toner supply nip. By applying a field in this nip, the well charged negative toner goes to the development roll, but the wrong sign toner stays with the supply roll, as well as some low charged toner.

The toner charging arrangement described above ensures that toner going into the charge/metering blade nip is all negatively charged toner and sufficient to support latent image development, even before it is charged further in the blade nip. In the case of the OEM toner, the toner flow and charging properties are optimized by the machine provider so that there is very little wrong sign (WS) or low charge (LC) toner particles in this nip. However, third party toner designs sometimes struggle to eliminate a WS/LC tail in the charge distribution. For example, when one replacement, i.e. non-OEM, toner is subjected to the same field as shown in FIG. 2, a smaller amount of well charged toner goes to the development roll, and more WS/LC charge toner stays in the toner sump. Eventually, as more and more prints are made, the toner particles remaining in the toner hopper are all the particles that charge poorly. At the mid to end of the cartridge life, the replacement toner density performance drops dramatically due to the development system selectively taking all the good charging particles first, i.e. small and round particles, and leaving all the poorly charging particles in the sump, i.e. larger and rough particles. Because conventional remanufacturing processes don't have the ability to adjust the biases in the machine or modify the development hardware design/materials, toner manufactures are forced to work on the toner design and manufacturing process to provide an OEM-like charge distribution.

Figure 4:
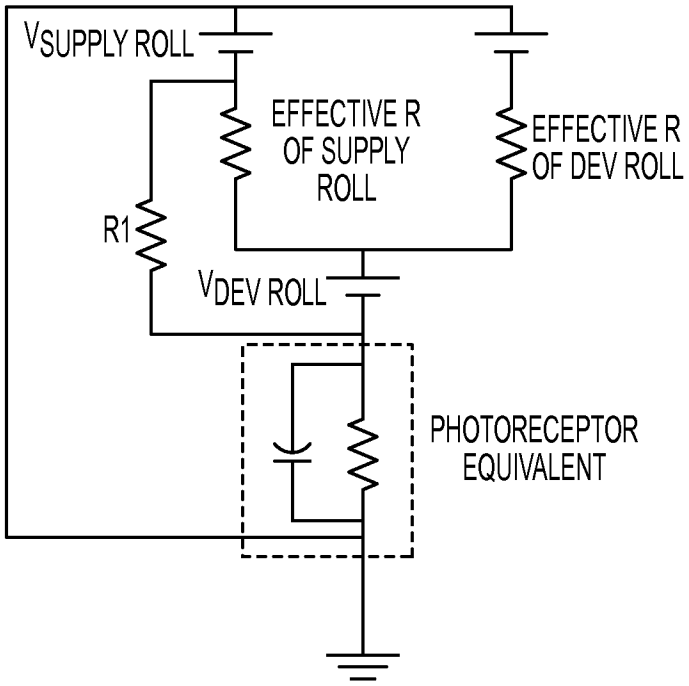
FIG. 4 is a schematic of an equivalent circuit of a toner cartridge according to an exemplary embodiment of this disclosure.
Figure 3:
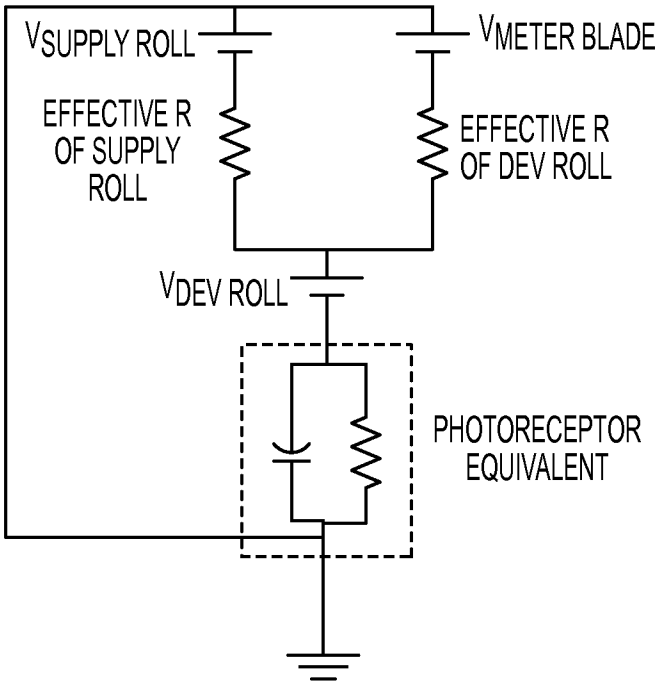
FIG. 3 is a schematic of an equivalent circuit of a toner cartridge.

Provided herein is a means to modify the field between the supply roll and development roll in order to reduce the amount of selectivity in the development system. This will enable aftermarket toner design to meet customer requirements for the entire life of the cartridge and will overcome the constraints of not being able to adjust machine setting for development hardware material properties in the field. According to one exemplary embodiment, a resistor is placed across the supply roll and the development contacts, thereby modifying the bias voltage between them to provide a method of reducing the amount of selective development occurring under normal operation. FIG. 3 shows a current bias schematic without the resistor and FIG. 4 shows a current bias schematic with the disclosed resistor. By adding the appropriate resistor (R1) in the circuit, the field between the supply roll and development is controlled according to the triboelectric charge properties of the replacement toner.

According to one example of replacement toner, this reduction of bias causes the loading of the development roll to be less selective in the toner it supplies to the metering blade, and hence, increases the life of a cartridge that may not have an OEM-like charge distribution. In the development stage of the system solution, testing is done to determine the value of the resistor required for varying toner designs, blade locations, and photoreceptor drum sensitivity to optimize the toner loading to provide the maximum benefit to development performance. Because the amount WS/LC charge toner being forced in the development nip will increase, the toner design, metering blade location, and/or photoreceptor sensitivity may need adjustment to balance good density stability with the background performance of the solution. Once the optimal resistance value has been determined, the resistor is added to the electrical contact assembly during the remanufacturing process.

Figure 5:
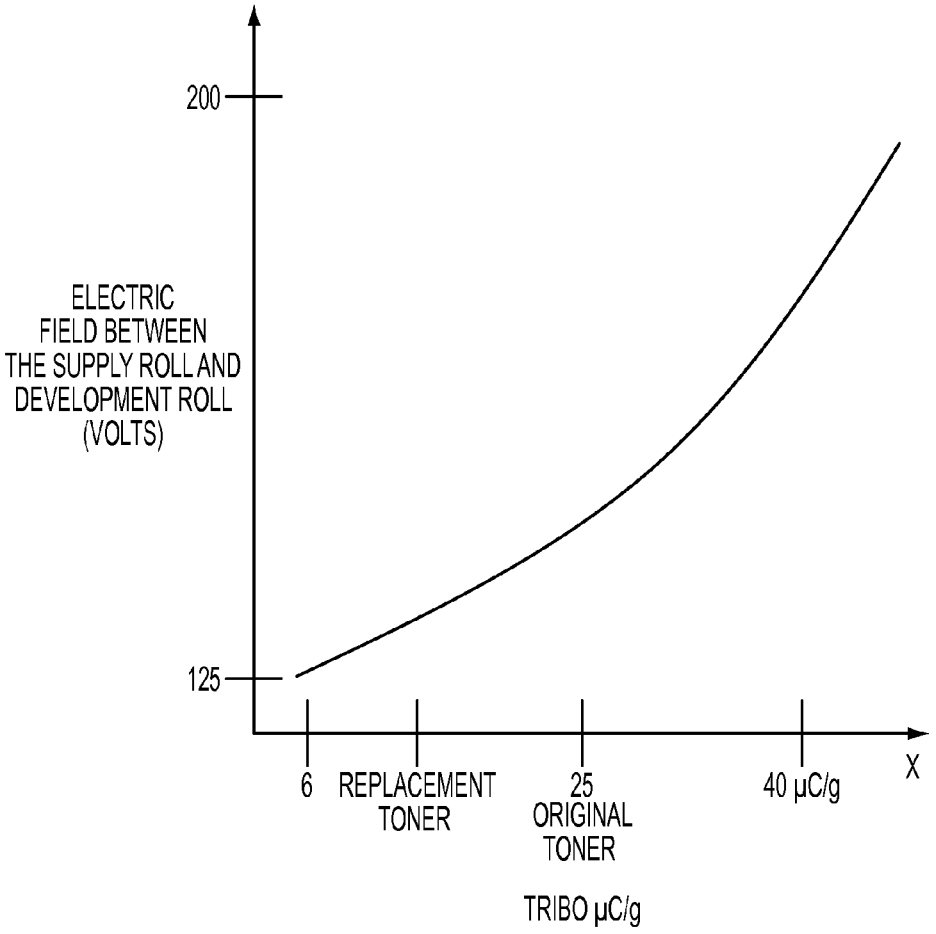
FIG. 5 is a plot of the triboelectric charge property associated with a toner and an associated supply roll/development roll electrical field according to an exemplary embodiment of this disclosure.

FIG. 5 is one example of a plot of the supply/development bias voltage required for a replacement toner and an original OEM toner. As shown, the plot shows the relationship of the triboelectric properties of a particular toner, specified in μC/g, vs. corresponding electric field between the supply and development rolls to support successful toner development.

Figure 6:
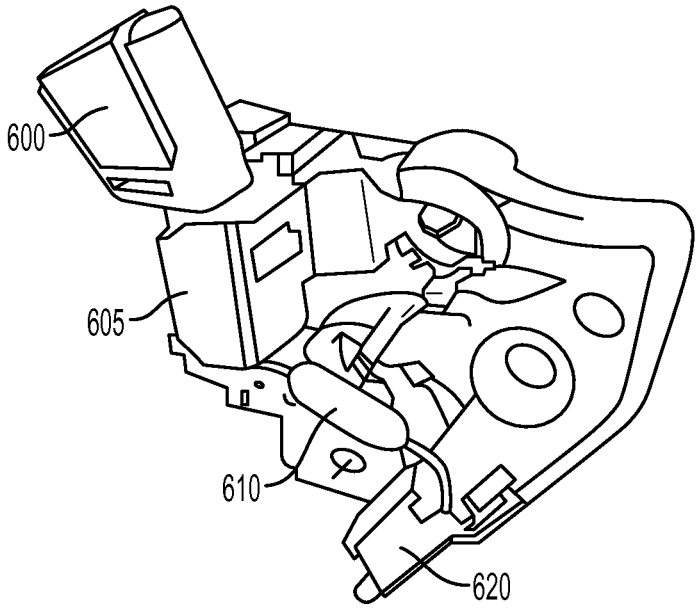
FIG. 6 illustrates an exemplary embodiment of an electrical contact associated with a remanufactured toner cartridge.

FIG. 6 shows one exemplary embodiment of a resistor 610 incorporated into the end cap of a toner cartridge to achieve a required supply/development bias voltage for one example of a replacement toner.

Figure 7:
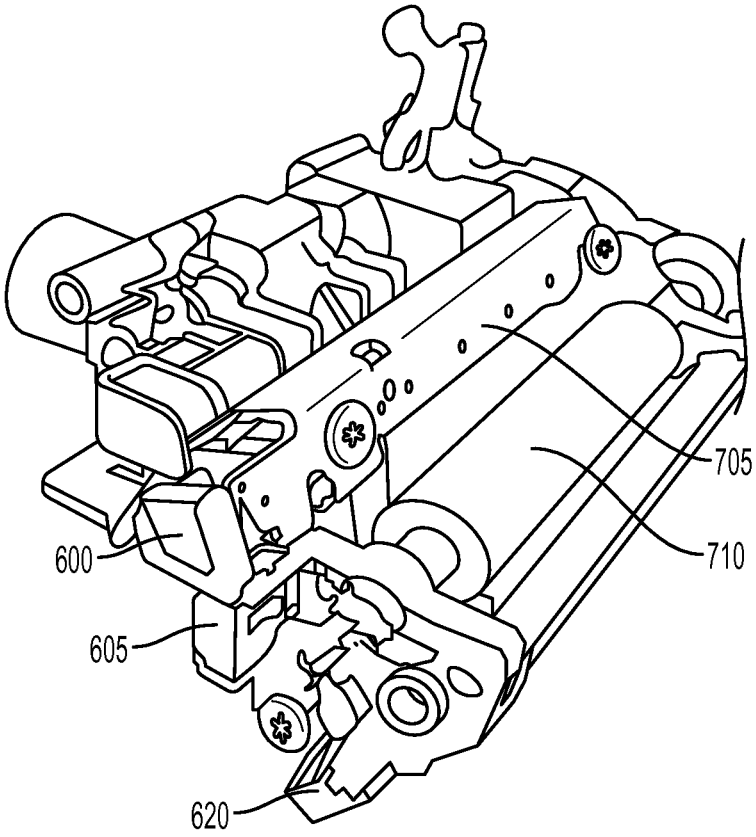
FIG. 7 shows a toner cartridge according to an exemplary embodiment of this disclosure.

As shown, the end cap includes a meter blade electrical contact 600, a development roll electrical contact 605, a resistor 610 and a supply roll electrical contact 620. For additional reference, FIG. 7 shows an end cap of a toner cartridge installed/fixed to a toner cartridge including a charge blade 705 and a development roll 710, without resistor R1 installed. In one embodiment, the resistor was chosen to be 50,000 ohms and reduced the field between the supply roll and the development roll by roughly 50 volts.

An alternative design can incorporate the resistor by providing a single copper or bronze stamping assembly that contains the resistor that could be supplied to replace the two current stampings during the remanufacturing process.

In summary, the provided remanufacturing method and remanufactured device include modifying the electric field between a supply roll and development roll in order to reduce the selective development of a toner that has a WS/LC tail in the distribution. This is accomplished by providing the simple addition of a resistor into the remanufacturing assembly process to modify the voltages applied to the development components, without any customer or field technician intervention.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A method of remanufacturing a non-magnetic toner cartridge associated with a first toner, the cartridge including a toner storage area, a toner supply roll, a development roll and a photosensitive drum, the method comprising:

a) refilling the toner storage area with a second toner, a triboelectric charge property associated with the second toner different from a triboelectric charge property associated with the first toner; and b) electrically connecting a resistor of a predetermined resistance between a toner supply roll contact and a development roll contact, the predetermined resistance of the resistor associated with a relative difference of the triboelectric charge properties associated with the first toner and second toner, wherein the resistor modifies an electric field between the toner supply roll and development roll during a use of the toner cartridge during an electrostatic process.

2. The method of remanufacturing a non-magnetic toner cartridge according to claim 1, wherein the electrostatic process is associated with printing.

3. The method of remanufacturing a non-magnetic toner cartridge according to claim 1, wherein the resistor is electrically connected to an electrical contact associated with the toner supply roll and an electrical contact associated with the development roll, and the electrical contacts are substantially near one longitudinal end associated with the toner cartridge.

4. The method of remanufacturing a non-magnetic toner cartridge according to claim 1, wherein the predetermined resistance of the resistor is a function of a bias voltage externally provided to the toner cartridge during normal use and the triboelectric charge property associated with the second toner.

5. The method of remanufacturing a non-magnetic toner cartridge according to claim 1, wherein the resistor modifies a bias voltage between the toner supply roll and the development roll.

6. The method of remanufacturing a non-magnetic toner cartridge according to claim 1, wherein a first stamping including the toner supply roll contact and a second stamping including the development roll contact is replaced with a single stamping including the resistor.

7. The method of remanufacturing a non-magnetic toner cartridge according to claim 1, wherein the triboelectric charge property associated with the second toner is less than or equal to 40 μC/g.

8. The method of remanufacturing a non-magnetic toner cartridge according to claim 1, wherein the modified electrical field is between 125 and 200 volts.

9. The method of remanufacturing a non-magnetic toner cartridge according to claim 1, further comprising:

replacing one or more of the photoreceptor drum, a cleaning blade, and a seal.

10. The method of remanufacturing a non-magnetic toner cartridge according to claim 1, wherein the resistor is a function of one or more of the triboelectric charge property of the second toner, a charge blade location, a cleaning blade location and a sensitivity of the photoreceptor drum.

11. A remanufactured non-magnetic toner cartridge comprising:

a toner storage area including replacement toner associated with a triboelectric charge property different than an original toner associated with the cartridge;

a toner supply roll operatively connected to a first electrical contact configured to connect to a power source external to the cartridge;

a development roll operatively connected to a second electrical contact configured to connect to a power source external to the cartridge;

a photosensitive drum; and a resistor operatively connected to the first electrical contact and the second electrical contact, wherein the resistor modifies an electric field between the toner supply roll and development roll to lead the replacement toner onto the development roll during a use of the toner cartridge during an electrostatic process.

12. The remanufactured non-magnetic toner cartridge according to claim 11, wherein the electrostatic process is associated with printing.

13. The remanufactured non-magnetic toner cartridge according to claim 11, wherein the resistor is electrically connected to an electrical contact associated with the toner supply roll and an electrical contact associated with the development roll, and the electrical contacts are substantially near one longitudinal end associated with the toner cartridge.

14. The remanufactured non-magnetic toner cartridge according to claim 11, wherein the predetermined resistance of the resistor is a function of a bias voltage externally provided to the toner cartridge during normal use and the triboelectric charge property associated with the second toner.

15. The remanufactured non-magnetic toner cartridge according to claim 11, wherein the resistor modifies an electric field between the toner supply roll and the development roll.

16. The remanufactured non-magnetic toner cartridge according to claim 11, wherein a first stamping including the toner supply roll contact and a second stamping including the development roll contact is replaced with a single stamping including the resistor.

17. The remanufactured non-magnetic toner cartridge according to claim 11, wherein the triboelectric charge property associated with the second toner is less than or equal to 40 μC/g.

18. The remanufactured non-magnetic toner cartridge according to claim 11, wherein the modified electrical field is a between 125 and 200 volts.

19. The remanufactured non-magnetic toner cartridge according to claim 11, further comprising further comprising:

replacing one or more of the photoreceptor drum, a cleaning blade, and a seal.

20. The remanufactured non-magnetic toner cartridge according to claim 11, wherein the resistor is a function of one or more of the triboelectric charge property of the second toner, a charge blade location, a cleaning blade location and a sensitivity of the photoreceptor drum.

21. A method of modifying an electrical field between a toner supply roll and a development roll associated with a remanufactured non-magnetic toner cartridge including a replacement toner, the method comprising:

operatively connecting a resistor between the toner supply roll and the development roll, wherein a resistance value of the resistor is selected to modify the electric field between the toner supply roll and the development roll based on a triboelectric property associated with the replacement toner.

* * * * *